US008212670B2

(12) United States Patent
Schebel et al.

(10) Patent No.: US 8,212,670 B2
(45) Date of Patent: Jul. 3, 2012

(54) COMPACT WIRELESS RECESSED SENSOR WITH PLUNGER SWITCH

(75) Inventors: Dean David Schebel, Port Coquitlam (CA); Julian P. Carlson, Surrey (CA); Russell E. Vandevanter, Seattle, WA (US)

(73) Assignee: ION Digital LLP, Blaine, WA (US)

( * ) Notice: Subject to any disclaimer, the term of this patent is extended or adjusted under 35 U.S.C. 154(b) by 341 days.

(21) Appl. No.: 12/549,123

(22) Filed: Aug. 27, 2009

(65) Prior Publication Data

US 2010/0102907 A1 Apr. 29, 2010

Related U.S. Application Data

(60) Provisional application No. 61/109,079, filed on Oct. 28, 2008.

(51) Int. Cl.
*G08B 13/08* (2006.01)

(52) U.S. Cl. ..... 340/545.2; 340/545.6; 340/511; 340/545.7

(58) Field of Classification Search ..... 340/546.5, 340/511, 545.7, 545.2; 200/61.93; 335/205
See application file for complete search history.

(56) References Cited

U.S. PATENT DOCUMENTS 3,725,887 A * 4/1973 Sneider ..... 340/539.3
4,336,518 A * 6/1982 Holce et al. ..... 335/205
4,437,255 A * 3/1984 Reed ..... 43/17
5,155,460 A * 10/1992 Huckins et al. ..... 335/205
6,737,969 B2 * 5/2004 Carlson et al. ..... 340/547
7,081,816 B2 * 7/2006 Schebel et al. ..... 340/545.6
7,088,251 B2 * 8/2006 Weilbacher, Jr. ..... 340/573.1
2006/0250260 A1 11/2006 Albert et al.

OTHER PUBLICATIONS

GE Recessed Roller Plunger with wire leads 3005 [1.5" long×0.75" diam.].
Honeywell Mini roller Contact Plunger with Terminals 956RPT [1.47" long×0.75" diam.].
AMSECO Rollerball Switch RSW-21 Series [1.68" long×0.71" diam].
George Risk Industries Short Roller Ball Switch DS-01 Series [1.31" long×0.73" diam.].
Honeywell 5818MNL Recessed Door/Window Transmitter (3.00" long by 0.75" diameter).
DSC EV-DW4917 Wireless Recessed Door Transmitter (2.50" long×0.75" diameter).

* cited by examiner

*Primary Examiner* — Hoi Lau
(74) *Attorney, Agent, or Firm* — Kathleen T. Petrich

(57) ABSTRACT

A compact wireless security sensor having a magnetically operated plunger switch. The compact nature of the sensor of the present invention makes it ideal for being substantially concealing into a door frame or window as part of a wireless security system. The sensor unit includes a housing having an inner end, an outer end, and a magnet positioned within a moveable plunger, and an antenna, preferably a flexible wire antenna. The housing further contains a sensor switch, a microprocessor with a PCB, a wireless transmitter, such as an RF transmitter, and a power source, such as a small coin cell battery, for emitting signals to a master station or controller when the plunger switch is depressed and activates the internal sensor switch.

7 Claims, 4 Drawing Sheets

COMPACT WIRELESS RECESSED SENSOR WITH PLUNGER SWITCH

RELATED APPLICATION

The present application claims priority to U.S. Provisional Patent Application Ser. No. 61/109,079, filed on Oct. 28, 2008, and entitled "Compact Wireless Recessed Sensor with Plunger Switch."

TECHNICAL FIELD

The present invention relates to compact wireless sensors with plunger switches, and, particularly for the insertion of these type sensors within door frames as a means for detecting intrusion.

BACKGROUND OF THE INVENTION

Magnetic plunger switches are well known in the industry, even for use as a sensor for sensing the presence of a movable object such as a door or window. Such an example is found in Huckins et al., U.S. Pat. No. 5,155,460 B1, issued in reexamination on May 16, 2005 and entitled "Switch Housing with Magnetic Roller Plunger." However, the Huckins invention is still hard wired and not sufficiently compact to be installed after-market into windows and doors without voiding the window or door manufacturer's warranty.

Other magnetic plunger switches exist even for the recessed market, but all in the "wired" version, such (i) GE Recessed Roller Plunger with wire leads 3005 [1.5" long× 0.75" diam.], (ii) Honeywell Mini roller Contact Plunger with Terminals 956RPT [1.47" long×0.75" diam.], (iii) AMSECO Rollerball Switch RSW-21 Series [1.68" long×0.71" diam], and (iv) George Risk Industries Short Roller Ball Switch DS-01 Series [1.31" long×0.73" diam.]). These "wired" designs have an advantage over earlier recessed switches in that an external magnet is not required to be setup, aligned, adjust, biased or hidden.

But if wireless signal transmission is desired, the length of the current recessed plunger switches are even larger than these wired switches as shown in examples such as the Honeywell 5818MNL Recessed Door/Window Transmitter (3.00" long by 0.75" diameter) or DSC EV-DW319 Recessed Door/Window Sensor (2.50" long×0.75" diameter). No compact wireless sensor with a plunger style switch was known to exist.

SUMMARY OF THE INVENTION

The present invention is directed to a compact wireless sensor having a plunger switch and has particular application for use in wireless security sensors used in doors and windows to sense and signal motion during intrusion.

The compact wireless sensor includes a housing having an inner end and an outer end with a magnet positioned within a moveable plunger, and an antenna. The housing further includes a sensor switch, a microprocessor, a wireless transmitter, and a power source, such as a small coin cell battery, for providing power to enable the sensor to emit signals to a remote master station or controller. When the moveable plunger is depressed, it actuates the internal sensor switch.

According to one aspect of the invention, the wireless sensor's electronics may be like those defined in U.S. Pat. No. 7,081,816, which allow the use of an exceptionally small coin cell battery. Because of the low current draw, the coin cell battery can be mounted underneath the electronics and the entire product can maintain a total size less than 1.10" long by 0.75" diameter, including the housing. This is particularly beneficial in after-market door and window security systems as the drilling within an existing door or window is minimal, recessed, substantially hidden from view, and may not void most window and door manufacturer's warranties.

According to another aspect of the invention, the sensor housing may be assembled in a longitudinally-oriented position to achieve longitudinal compactness of size. According to this embodiment, the plunger switch is positioned directly atop of the sensor electronics and power source to provide a compact overall height.

According to yet another aspect of the invention, a moisture barrier, such as a plastic wall, may be used to isolate the plunger switch and magnet elements from the electronic portions of the wireless sensor (namely, a printed circuit board "PCB" connected to the microprocessor), which protects otherwise sensitive electronic elements from potential casual water ingress from weather or cleaning In yet another embodiment, the magnet of the plunger may be mechanically aligned or "keyed", such that the depressed plunger maintains a desired orientation to the sensor switch, such as a reed switch, positioned on the separated wireless PCB assembly. The resultant magnetic field when the plunger is depressed triggers the magnet sensor (e.g., a reed switch) to initiate wireless communication.

As discussed in the Background of the Invention, other wired recessed plunger switches can be seen to be at least 1.3" long (or greater) and typically 0.75" in diameter. Other wireless recessed switches (without a plunger switch) can be seen to be at least 2.5" long and 0.75" in diameter. This invention combines both the plunger switch, such as a roller-type plunger, and a wireless sensor within the approximate dimensions in the ranger of an inch or less, and in a preferred form approximately less than 1.1 inch long and 0.75 inch in diameter. The compact size makes the present invention ideally suitable for a variety of wireless security systems.

These and other advantages will become more apparent upon review of the Drawings, the Best Mode for Carrying out the Invention, and the Claims.

BRIEF DESCRIPTION OF THE DRAWINGS

Like reference numerals are used to designate like parts throughout the several views of the drawings, wherein:

FIG. 1(*b*) is a front view of FIG. 1(*a*);

FIG. 1(*c*) is a section view of the sensor of FIG. 1(*a*) taken substantially along lines A-A of FIG. 1(*b*);

FIG. 1(*d*) is a top view of FIG. 1(*a*);

FIG. 1(*e*) is a section view of the sensor of FIG. 1(*a*) taken substantially along lines B-B of FIG. 1(*d*);

FIG. 2(*b*) is a front view of FIG. 2(*a*);

FIG. 2(*c*) is a section view of the sensor of FIG. 2(*a*) taken substantially along lines C-C of FIG. 2(*b*);

FIG. 2(*d*) is a top view of FIG. 2(*a*);

FIG. 2(*e*) is a section view of the sensor of FIG. 2(*a*) taken substantially along lines D-D of FIG. 2(*d*);

FIG. 4(*b*) is a top view of FIG. 4(*a*);

FIG. 4(*c*) is a side view illustrating the same relationship of FIG. 4(*a*) except that the switch is shown in the closed position;

FIG. 4(*d*) is a top view of FIG. 4(*c*);

FIG. 4(*e*) is a side view illustrating the same relationship of FIG. 4(*a*) except that the switch is mounted at an angle of 270 degrees relative to the PCB surface;

FIG. 4(*f*) is a top view of FIG. 4(*e*);

FIG. 4(*g*) is a side view illustrating the same relationship of FIG. 4(*e*) except that the switch is in the closed position; and FIG. 4(*h*) is a top view of FIG. 4(*g*).

BEST MODE FOR CARRYING OUT THE INVENTION

Figure 1A:
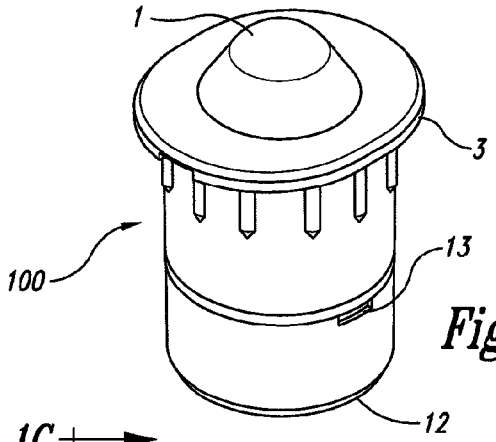
FIG. 1(*a*) is a perspective view of an embodiment of the invention illustrating a compact wireless sensor (less antenna) having a plunger switch shown in the fully open position.
Figure 1B:
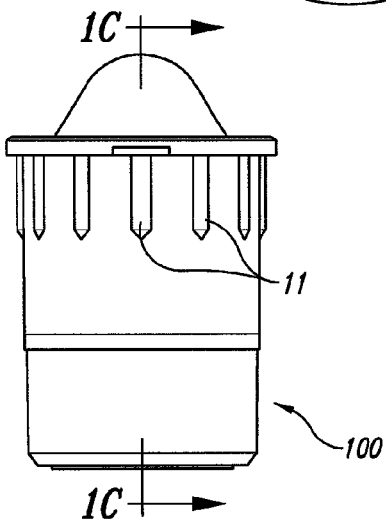
Figure 1C:
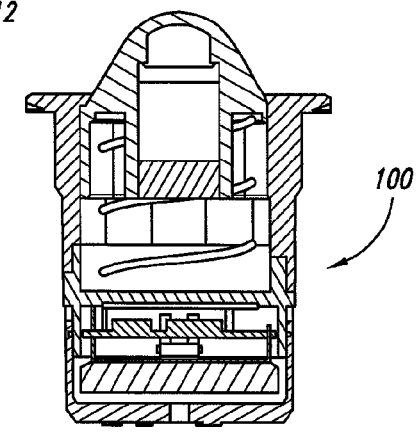
Figure 1D:
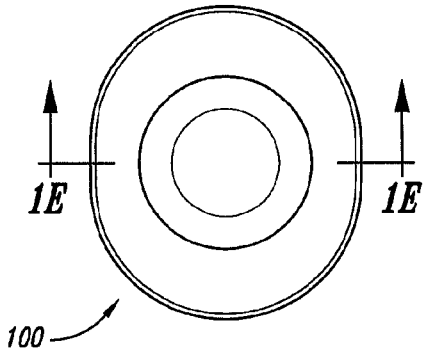
Figure 1E:
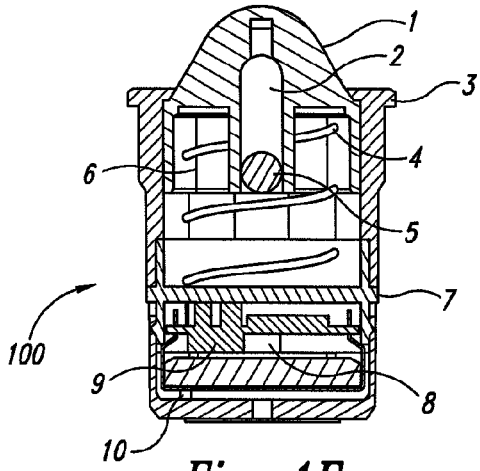
Figure 2A:
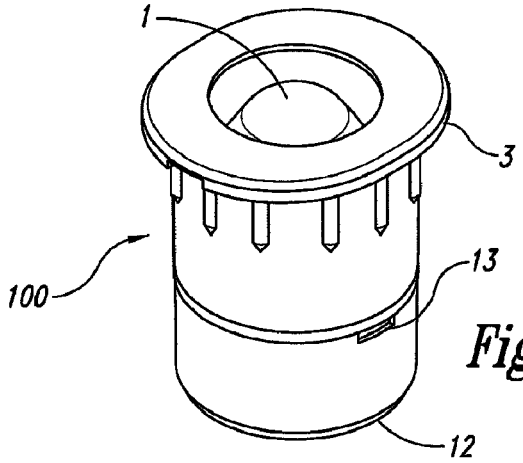
FIG. 2(*a*) is a perspective view of the sensor embodiment of FIG. 1(*a*) but now illustrated with the plunger switch in the fully closed position.
Figure 2B:
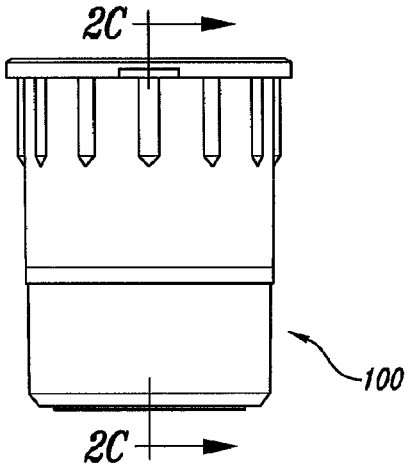
Figure 2C:
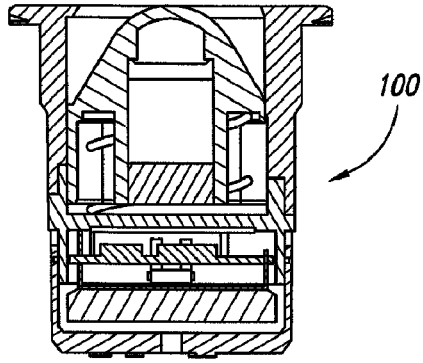
Figure 2D:
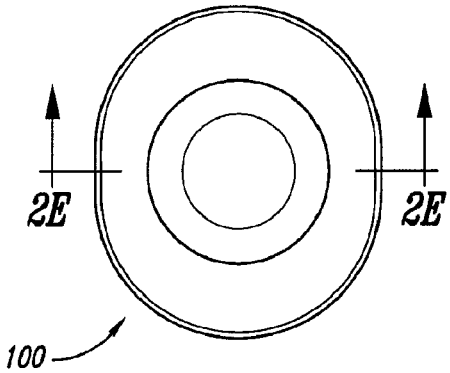
Figure 2E:
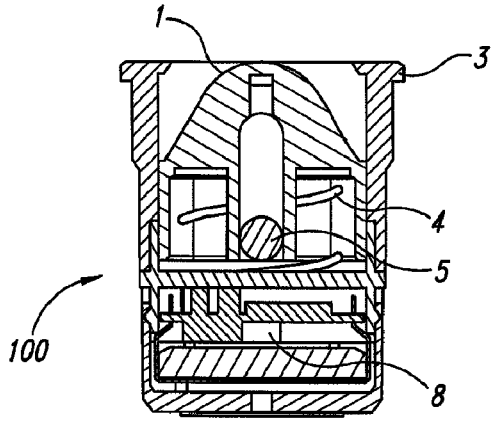
Figure 3:
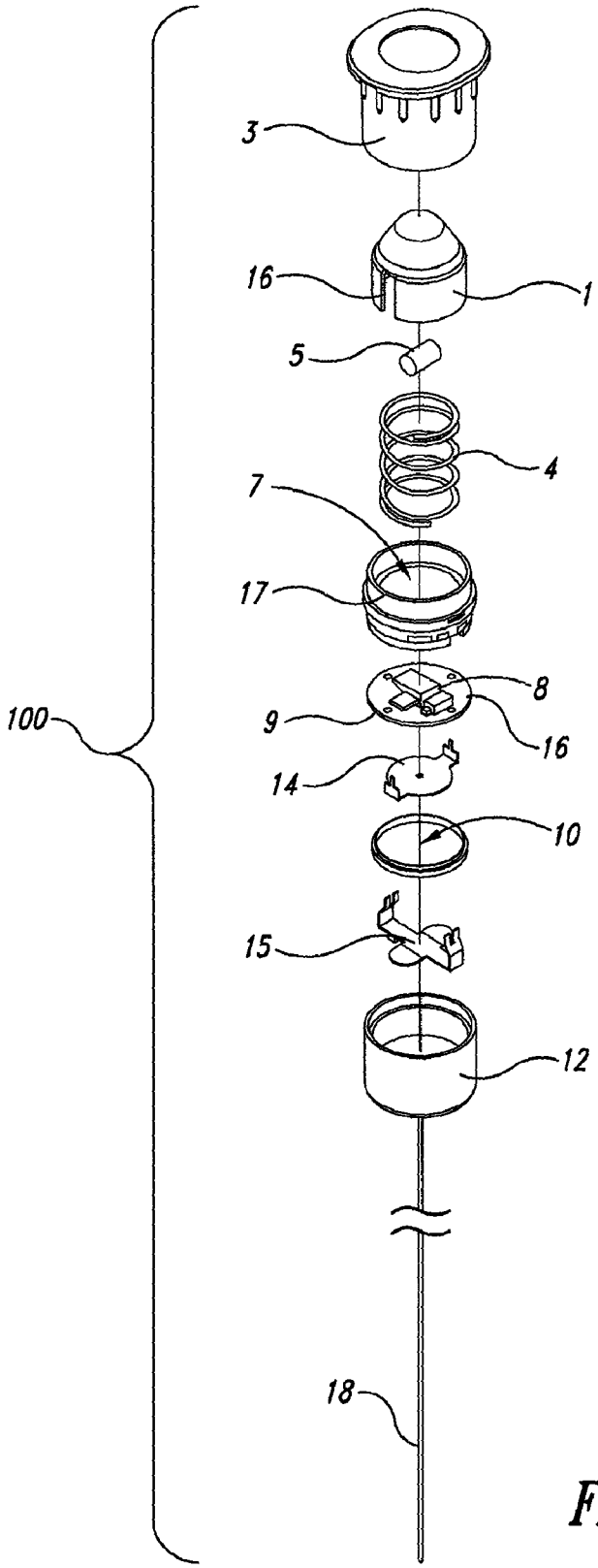
FIG. 3 is an exploded perspective view of an embodiment of the invention.
Figure 4A:
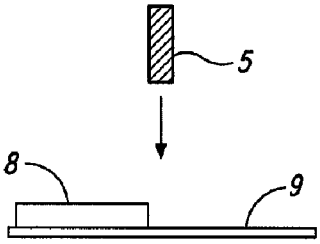
FIG. 4(*a*) is a side view illustrating the positioning of the switch and magnet relative to the PCB in the open position where the reed switch is mounted at 180 degrees on the PCB surface.
Figure 4C:
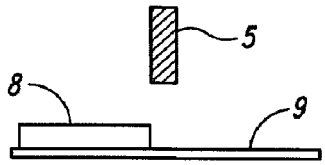
Figure 4B:
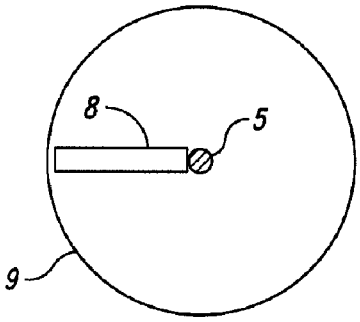
Figure 4D:
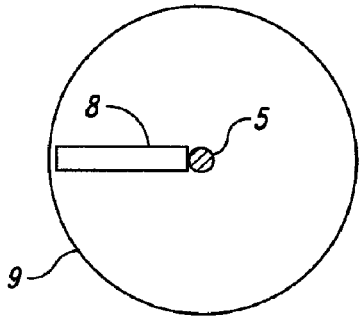
Figure 4E:
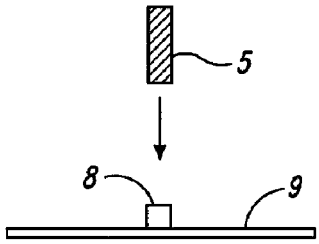
Figure 4G:
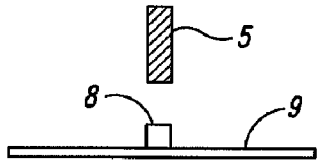
Figure 4F:
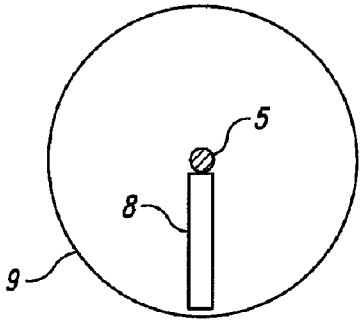
Figure 4H:
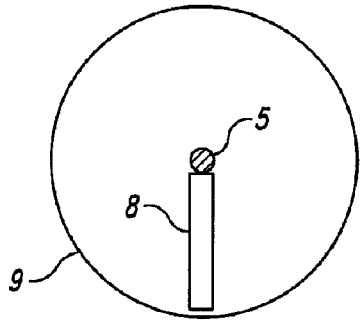

Referring to FIGS. 1-3 (including all subparts), an embodiment of the present invention illustrates a compact wireless recessed sensor have a plunger switch (100). According to one embodiment of the invention, a hollow, dome-shaped plunger (1) has a small rod type magnet (5) that is inserted within the plunger in a small hollow in its center (2) and fastened in place. The plunger is supported within a frame assembly composed of a spring housing (3) and a middle frame (7) with a spring (4), that allows the plunger to move between a fully open position (FIGS. 1(*a*)-(*e*)) and a fully closed position (FIGS. 2(*a*)-(*e*)).

The frame which includes the spring housing (3) and the middle frame (7), are fastened together during assembly (e.g., glued or sonic welded) to keep the plunger (1), magnet (5), and spring (4) from being removed from the frame. The spring may be inserted inside the outer wall of the hollow plunger (6). The plunger (1), spring housing (3), and middle housing (7) may be keyed so that the magnet (5) remains in a fixed orientation relative to the frame assembly. In FIG. 3, the plunger (1) key (16) is shown, and the middle frame (7) key (17) is shown. The key within the spring housing (3) is hidden in the exploded view of FIG. 3.

The sensor further includes a microprocessor attached to a PCB (9), which may also be keyed to the bottom of the middle frame (7). Thus keyed, a sensor switch, such as reed switch (8), can maintain a proper orientation to the magnet (5) for operation of the magnetic sensor. Other sensors may be used, such as a hall effect, MEMS magnetic, or other sensors known by those of skill. Also shown in the exploded view are examples of a preferred battery clip arrangement showing the negative clip (14) and positive clip (15) such that the battery as needs be mounted directly below the PCB to minimize size of the entire package. An antenna, such as a flexible wire antenna (18), is secured or otherwise fastened (such as by soldering) to the positive clip in a preferred embodiment. Other types of antenna, such as loop, helical, chip or other well-known to those of skill, may be used.

An alternate magnetic sensor alignment technique is shown in FIG. 4, where a similar rod magnet (5) is aligned perpendicularly to the reed switch (8) on the PCB (9) aligned such that when the plunger/magnet assembly is depressed, the sensor is activated.

An advantage of this method is that no extra mechanical keying is required for the frame assembly and PCB. As long as the magnet is aligned over the center of the circular PCB, and the magnetic sensor is mounted in an outwardly fashion from the center of the PCB, any rotation of the plunger/magnet assembly relative to the PCB still maintains an appropriately oriented magnetic field to the sensor allowing it to trigger the sensor when it gets depressed and close to the PCB. FIGS. 4 (*a*)-(*b*) illustrates side and top views of the PCB (9) reed switch (8) and magnet (5) in the open position at when the reed switch is mounted at 180 degrees on the PCB. FIGS. 4(*c*)-(*d*) illustrate the same views except in the closed position. FIGS. 4(*e*)-(*h*) illustrate the same operation when the reed switch is at an arbitrary angle, in this case mounted on the PCB at an angle of 270 degrees.

The assembled frame may also act to separate the plunger assembly from the wireless sensor PCB electronics (8), reed switch (9), and battery (10), which are mounted on the bottom side of the frame, and isolate from the plunger assembly by a moisture barrier, such as a thin plastic wall of the middle frame (7). This barrier serves to prevent moisture from entering from the plunger side of the frame and affecting the electronics.

The electronics may be similar to the electronics described in the applicants' previous U.S. Pat. No. 7,081,816, which is hereby incorporated by reference, and serve to identify and wireless transmit a message when a change of state or other timing criteria are met, including a low power clock circuit, low battery voltage detection, and a brown-out detection circuit. The compact wireless sensor of the present invention may be utilized similar to the compact wireless sensor of applicants' previous U.S. Pat. No. 6,737,969, which is also incorporated by reference.

A battery cover (12) may be used to close up the electronics and to also provide an exit hole for a wire antenna (18) used by the device for wireless (e.g., RF) transmission. This battery cover (12) may feature a snap on closure (as illustrated) in order to snap the cover into place. A small slot (13) may be added to aid in the removal of the battery cover.

The illustrated embodiments are only examples of the present invention and, therefore, are non-limitive. It is to be understood that many changes in the particular structure, materials, and features of the invention may be made without departing from the spirit and scope of the invention. Therefore, it is the applicants' intention that its patent rights not be limited by the particular embodiments illustrated and described herein, but rather by the following claims interpreted according to accepted doctrines of claim interpretation, including the Doctrine of Equivalents and Reversal of Parts.

What is claimed is:

1. A compact wireless security sensor comprising:

a frame assembly having a spring housing and an axially aligned middle frame, said frame assembly defining an interior and an exterior and in which a barrier is positioned between the spring housing and the aligned middle frame;

a magnet positioned within a moveable plunger and a spring forming a plunger assembly, wherein said plunger assembly is positioned within said spring housing;

a sensor switch, a microprocessor having a PCB, and a wireless transmitter forming sensor components, all contained within the middle frame and separated from the plunger assembly by the barrier, wherein the sensor components are axially aligned with the plunger assembly; and a substantially external antenna.

2. The compact wireless security sensor according to claim 1 wherein the plunger assembly is positioned atop of the sensor components within the housing.

3. The compact wireless security sensor according to claim 2 wherein the magnet is mechanically aligned to maintain a desired orientation to the sensor switch.

4. The compact wireless security sensor according to claim 1 wherein the overall longitudinal length of the housing is no greater than 1.1 inch.

5. The compact wireless security sensor according to claim 1 wherein the sensor switch is a reed switch.

6. The compact wireless security sensor according to claim 2 wherein the sensor switch is a reed switch.

7. The compact wireless security sensor according to claim 1 wherein the plunger assembly is a roller-style plunger.

* * * * *